United States Patent [19]

Pouderoux

[11] 4,148,686

[45] Apr. 10, 1979

[54] AUXILIARY COOLING DEVICE FOR THE PRIMARY FLUID HEAT EXCHANGER OF A NUCLEAR REACTOR

[75] Inventor: Pierre Pouderoux, Meudon, France

[73] Assignee: Stein Industrie S.A., Velizy-Villacoublay, France

[21] Appl. No.: 749,261

[22] Filed: Dec. 10, 1976

[30] Foreign Application Priority Data

Dec. 18, 1975 [FR] France ..... 75 38835

[51] Int. Cl.[2] ..... G21C 9/00

[52] U.S. Cl. ..... 176/38; 176/40; 176/65

[58] Field of Search ..... 176/38, 61, 65, 40, 176/50, 62, 63, 64

[56] References Cited

U.S. PATENT DOCUMENTS 4,056,439 11/1977 Robin ..... 176/65

*Primary Examiner*—Samuel W. Engle
*Assistant Examiner*—Ralph Palo
*Attorney, Agent, or Firm*—Haseltine, Lake & Waters

[57] ABSTRACT

An auxiliary cooling device for a primary fluid heat exchanger of a rapid neutron nuclear reactor, the exchanger having at least one nest of tubes in which there flows water to be heated to superheated steam and around whose tubes and inside whose casing there flows a liquid alkaline metal constituting the primary fluid. The casing of the exchanger is surrounded by a jacket having an air inlet tube and an air outlet tube at opposite ends. Inside the jacket there are auxiliary heat exchange surfaces such as spikes projecting from the casing of the primary heat exchanger proper. Application is to the absorption of residual power produced by a rapid neutron reactor after it is shut down.

13 Claims, 1 Drawing Figure

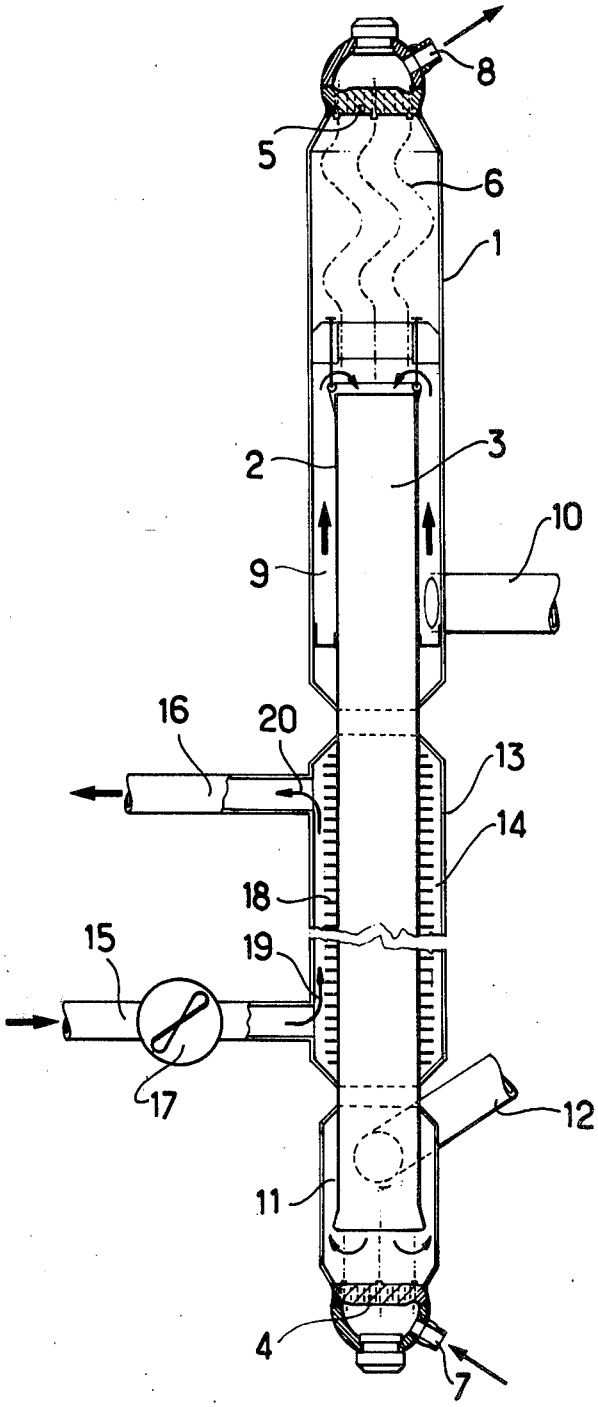
8
5
6
1
2
3
10
9
16
20
13
14
18
15
19
17
12
11
4
7

AUXILIARY COOLING DEVICE FOR THE PRIMARY FLUID HEAT EXCHANGER OF A NUCLEAR REACTOR

FIELD OF THE INVENTION

The present invention relates to an auxiliary cooling device for a primary fluid heat exchanger of a rapid neutron nuclear reactor. The exchanger comprises at least one nest of tubes in which there flows cooling water (to be heated to superheated steam) and round whose tubes there flows a liquid alkaline metal constituting said primary fluid.

BACKGROUND

When a rapid neutron nuclear reactor is shut down, the power supplied does not die away instantaneously, but reduces gradually for some time before dying completely away. This residual power may be absorbed in special heat exchangers, to which the heated liquid alkaline metal is conveyed, instead of to the normal operation exchangers. Such special exchangers are however relatively expensive and are used for fairly short periods of operation. They therefore substantially increase the cost price of nuclear power stations using rapid neutron nuclear reactors.

SUMMARY OF THE INVENTION

Preferred embodiments of the present invention reduce this disadvantage and provide at a relatively low cost an auxiliary cooling device which is able to absorb the variable residual power of a rapid neutron reactor. The device according to the invention comprises an auxiliary cooling device for absorbing residual energy in a primary fluid heat exchanger of a nuclear reactor which continues to generate some energy after shut down, said exchanger comprising a casing for conveying a flow of primary fluid heated in the reactor and a nest of tubes disposed inside the casing for conveying a secondary cooling fluid in thermal contact with the primary fluid, said auxiliary cooling device comprising a jacket disposed around the casing and including inlet means and outlet means for an auxiliary cooling fluid, and auxiliary heat exchange surfaces projecting from said casing into the space around the casing inside said jacket.

It also preferably has at least one of the following features:

- the auxiliary cooling fluid is air;
- the auxiliary heat exchange surfaces are spikes;
- the auxiliary cooling fluid inlet and outlet means include means for providing a forced flow of auxiliary cooling fluid;
- the auxiliary cooling fluid is free to flow by convection.

The present invention also provides a heat exchanger including said cooling device and a reactor installation including said heat exchanger.

BRIEF DESCRIPTION OF THE DRAWING

A heat exchanger module equipped with the cooling device according to the invention is described hereinbelow by way of example with reference to the single FIGURE of the accompanying drawing.

DETAILED DESCRIPTION

The heat exchanger module, which can be grouped in parallel with other modules, includes a jacket or outer casing 1 having a generally cylindrical shape, inside which is disposed a coaxial inner casing 2 surrounding a nest of tubes 3, comprising a large number of parallel tubes, not shown. The nest of tubes 3 is connected to a lower tubular plate 4 and to an upper tubular plate 5, the tubes forming at their top part an expansion-bend 6. The nest of tubes is intended to convey the flow of water which is to be heated to superheated steam. The water is admitted at the bottom part of the module through tubing 7 and is discharged in the state of superheated steam at the upper part through tubing 8. An annular space 9 disposed in the upper part of the module between the casings 1 and 2 is connected to inlet tubing 10 for liquid sodium heated in a rapid neutron nuclear reactor. During normal operation, the liquid sodium rises between the casings 1 and 2, then flows into the casing 2 around the tubes of the nest 3, in opposition to the flow of the water which is to be vaporized and superheated. An annular space 11 disposed in the lower part of the module between the casings 1 and 2 is connected to tubing 12 for discharging the liquid sodium cooled in the exchanger.

The casing 1 of the module is surrounded over its entire height between the annular inlet space 9 and the outlet space 10 with a coaxial outer casing or jacket 13 defining an annular space 14 with casing 2. This space 14 is connected to an ambient air inlet tube 15 and an ambient air outlet tube 16. A blower 17 ensures the circulation of air in the annular space 14. Horizontal spikes 18 are provided over the entire height of the outer surface of the casing 1 that is under the jacket 13. The spikes 18 serve to improve the heat exchange coefficient between the liquid sodium and the air blown through the space 14 when the nuclear reactor is shut down.

When a rapid neutron nuclear reactor is shut down, the power which it supplies does not die away immediately, but decreases gradually. As the flow of water must be stopped on shut down, the residual power must be dissipated elsewhere until its supply has died away. This dissipation is effected by heat exchange between the sodium and the air flowing in the annular space 14 in the direction shown by arrows 19, 20. However, as the heat exchange coefficient of air is relatively low, it is improved by the use of the spikes 18 so as to ensure the dissipation of the residual heat with a moderate air flow. The spikes 18 are immersed in the air flow and may have a height which is of the order of half the width of the annular space 14. These spikes 18 could be replaced by other auxiliary heat exchange means, such as vertical fins.

When the residual power generated by the nuclear reactor has greatly decreased, it is possible to stop the air blower as the natural air flow by convection becomes sufficient to dissipate the remaining fraction of residual power.

If the water/sodium heat exchanger is composed of several modules grouped together in parallel, it is preferable to provide only one blower feeding air to the coverings of the various modules through appropriate tubes.

Although the structure of the heat exchange module which has just been described appears to be preferable, it will be understood that various modifications can be made thereto without going beyond the scope of the invention, it being possible to replace particular elements described by others which fulfill the same technical function.

What is claimed is:

1. An auxiliary cooling device for absorbing residual energy in a primary fluid heat exchanger of a nuclear reactor which continues to generate energy after shut down, said exchanger comprising a casing for conveying a flow of primary fluid heated in the reactor and a nest of tubes disposed inside the casing for conveying a secondary cooling fluid in thermal contact with the primary fluid, said auxiliary cooling device comprising a jacket disposed around the casing and including inlet means and outlet means for an auxiliary cooling fluid, and auxiliary heat exchange surfaces projecting from said casing into the space around the casing inside said jacket.

2. An auxiliary cooling device according to claim 1 wherein the auxiliary cooling fluid is air.

3. An auxiliary cooling device according to claim 1 wherein the auxiliary heat exchange surfaces are constituted by spikes.

4. An auxiliary cooling device according to claim 1 wherein the auxiliary cooling fluid inlet and outlet means include means for providing a forced flow of auxiliary cooling fluid.

5. An auxiliary cooling device according to claim 1 wherein the auxiliary cooling fluid is free to flow by convection.

6. An assembly of auxiliary cooling devices according to claim 4 comprising a plurality of primary heat exchangers connected in parallel each equipped with an auxiliary cooling device wherein the auxiliary cooling devices are connected to a common source of forced flow for the auxiliary cooling fluid.

7. A primary fluid heat exchanger for a nuclear reactor which continues to generate energy after shut down, said exchanger comprising a casing for conveying a flow of primary fluid heated in the reactor and a nest of tubes disposed inside the casing for conveying a secondary cooling fluid in thermal contact with the primary fluid and the auxiliary cooling device of claim 1.

8. A primary fluid heat exchanger according to claim 7 wherein the secondary cooling fluid is water which is heated to superheated steam.

9. A primary fluid heat exchanger according to claim 7 including a primary fluid jacket over portions of the casing adjacent each of its ends, the jacket of the auxiliary cooling device being disposed intermediate the portions of the primary fluid jacket.

10. A rapid neutron nuclear reactor installation including the heat exchanger of claim 7.

11. A reactor installation according to claim 10 wherein the primary fluid heated by the reactor is an alkaline metal.

12. An auxiliary cooling device according to claim 1 including a primary fluid jacket over portions of the casing adjacent each of its ends, the jacket of the auxiliary cooling device being disposed intermediate the portions of the primary fluid jacket.

13. An auxiliary cooling device according to claim 1 wherein the secondary cooling fluid is water which is heated to superheated steam.

* * * * *